United States Patent [19]

Merchant

[11] Patent Number: 4,999,127

[45] Date of Patent: Mar. 12, 1991

[54] AZEOTROPIC COMPOSITION OF 2-CHLORO-1,1,2-TRIFLUOROETHYL-2-DIFLUOROMETHYL ETHER WITH TRANS-1,2-DICHLOROETHYLENE AND METHNANOL

[75] Inventor: Abid N. Merchant, Wilmington, Del.

[73] Assignee: E. I. Du Pont de Nemours and Company, Wilmington, Del.

[21] Appl. No.: 448,474

[22] Filed: Dec. 11, 1989

[51] Int. Cl.[5] ..... C11D 7/30; C11D 7/50

[52] U.S. Cl. ..... 252/171; 62/114; 134/12; 252/67; 252/162; 252/170; 252/305; 252/364; 252/DIG. 9; 521/131

[58] Field of Search ..... 252/67, 69, 162, 170, 252/171, 364, DIG. 9, 305; 521/131; 134/12, 38, 39, 40; 62/114

[56] References Cited

U.S. PATENT DOCUMENTS 4,767,561 8/1988 Gorski ..... 252/171

FOREIGN PATENT DOCUMENTS 0314551 5/1989 European Pat. Off. .
0314571 5/1989 European Pat. Off. .

*Primary Examiner*—Paul Lieberman
*Assistant Examiner*—A. Beadles-Hay
*Attorney, Agent, or Firm*—James E. Shipley

[57] ABSTRACT

Azeotropic mixtures of 2-chloro-1,1,2-trifluroethyl-2-difluoromethyl ether and trans-1,2-dichloroethylene with methanol, the azeotropic mixtures being useful in solvent cleaning applications.

9 Claims, No Drawings

AZEOTROPIC COMPOSITION OF 2-CHLORO-1,1,2-TRIFLUOROETHYL-2-DIFLUOROMETHYL ETHER WITH TRANS-1,2-DICHLOROETHYLENE AND METHNANOL

BACKGROUND OF THE INVENTION

As modern electronic circuit boards evolve toward increased circuit and component densities, through board cleaning after soldering becomes a more important criterion. Current industrial processes for soldering electronic components to circuit boards involve coating the entire circuit side of the board with flux and thereafter passing the flux-coated board over preheaters and through molten solder. The flux cleans the conductive metal parts and promotes solder fusion. Commonly used solder fluxes generally consist of rosin, either used alone or with activating additives, such as amine hydrochlorides or oxalic acid derivatives.

After soldering, which thermally degrades part of the rosin, the flux-residues are often removed from the circuit boards with an organic solvent. The requirements for such solvents are very stringent. Defluxing solvents should have the following characteristics: a low boiling point, be nonflammable, have low toxicity and have high solvency power, so that flux and flux-residues can be removed without damaging the substrate being cleaned.

While boiling point, flammability and solvent power characteristics can often be adjusted by preparing solvent mixtures, these mixtures are often unsatisfactory because they fractionate to an undesirable degree during use. Such solvent mixtures also fractionate during solvent distillation, which makes it virtually impossible to recover a solvent mixture with the original composition.

On the other hand, azeotropic mixtures, with their constant boiling points and constant compositions, have been found to be very useful for these applications. Azeotropic mixtures exhibit either a maximum or minimum boiling point and they do not fractionate on boiling. These characteristics are also important when using solvent compositions to remove solder fluxes and flux-residues from printed circuit boards. Preferential evaporation of the more volatile solvent mixture components would occur, if the mixtures were not azeotropic and would result in mixtures with changed compositions, and with attendant less-desirable solvency properties, such as lower rosin flux solvency and lower inertness toward the electrical components being cleaned. The azeotropic character is also desirable in vapor degreasing operations, where redistilled solvent is generally employed for final rinse cleaning. In summary, vapor defluxing and degreasing systems act as a still. Unless the solvent composition exhibits a constant boiling point, i.e., is an azeotrope, fractionation will occur and undesirable solvent distributions will result, which could detrimentally affect the safety and efficacy of the cleaning operation.

A number of chlorofluorocarbon based azeotropic compositions have been discovered and in some cases used as solvents for solder flux and flux-residue removal from printed circuit boards and also for miscellaneous degreasing applications. For example: U.S. Pat. No. 3,903,009 discloses the azeotrope of 1,1,2-trichloro-1,2,2-trifluoroethane with ethanol and nitromethane; U.S. Pat. No. 2,999,815 discloses the binary azeotrope of 1,1,2-trichloro-1,2,2-trifluoroethane and acetone; U.S. Pat. No. 2,999,817 discloses the binary azeotrope of 1,1,2-trichloro-1,2,2-trifluoroethane and methylene chloride.

Some of the chlorofluorocarbons which are currently used for cleaning and other applications have been theoretically linked to depletion of the earth's ozone layer. As early as the mid-1970's, it was known that introduction of hydrogen into the chemical structure of previously fully-halogenated chlorofluorocarbons reduced the chemical stability of these compounds. Hence, these now destabilized compounds would be expected to degrade in the lower atmosphere and not reach the stratospheric ozone layer in-tact. What is also needed, therefore, are substitute chlorofluorocarbons which have low theoretical ozone depletion potentials.

Unfortunately, as recognized in the art, it is not possible to predict the formation of azeotropes. This fact obviously complicates the search for new azeotropic compositions, which have application in the field. Nevertheless, there is a constant effort in the art to discover new azeotropes, which have desirable solvency characteristics and particularly greater versatilities in solvency power.

SUMMARY OF THE INVENTION

According to the present invention, azeotropic compositions have been discovered comprising admixtures of effective amounts of 2-chloro-1,1,2-trifluoroethyl-2-difluoromethyl ether, trans-1,2-dichloroethylene and methanol. The azeotrope comprises an admixture of about 24–34 weight percent 2-chloro-1,1,2-trifluoroethyl-2-difluoromethyl ether and about 54–74 weight percent trans-1,2-dichloroethylene and about 4–10 weight percent methanol. Also included in the present invention is an azeotrope consisting essentially of about 24–34 weight percent 2-chloro-1,1,2-trifluoroethyl-2-difluoromethyl ether, about 54–74 weight percent trans-1,2-dichloroethylene and about 4–10 weight percent methanol.

The present invention provides azeotropic compositions which are well suited for use in solvent cleaning, blowing agent, propellant and refrigerant applications.

DETAILED DESCRIPTION OF THE INVENTION

The composition of the instant invention comprises an admixture of effective amounts of 2-chloro-1,1,2-trifluoroethyl-2-difluoromethyl ether ($CHF_2$-CClF-O-$CHF_2$, boiling point=56.5° C.) and trans-1,2-dichloroethylene (CHCl=CHCl, boiling point=48.0° C.) and methanol (boiling point=64.6° C.), to form an azeotropic mixture. The aforementioned haloolefin is known as trans-HCC-1130 in the nomenclature conventional to the halocarbon field.

By azeotropic composition is meant, a constant boiling liquid admixture of three or more substances, whose admixture behaves as a single substance, in that the vapor, produced by partial evaporation or distillation of the liquid has the same composition as the liquid, i.e., the admixture distills without substantial composition change. Constant boiling compositions, which are characterized as azeotropes, exhibit either a maximum or minimum boiling point, as compared with that of the nonazeotropic mixtures of the same substances.

By effective amount is meant the amount of each component of the instant invention admixture, which when combined, results in the formation of the azeotrope of the instant invention. The language "consisting essentially of an azeotrope" is not meant to exclude the presence of other materials which do not significantly alter the azeotropic behavior of the ternary azeotropic composition of the present invention.

As used herein "consisting essentially of" is not intended to exclude the presence of other materials not specifically set forth herein which do not significantly alter the azeotropic characteristics of the recited azeotrope.

It is possible to fingerprint, in effect, a constant boiling admixture, which may appear under many guises, depending upon the conditions chosen, by any of several criteria:

The composition can be defined as an azeotrope of A, B and C, since the very term "azeotrope" is at once both definitive and limitative, and requires that effective amounts A, B and C form this unique composition of matter, which is a constant boiling admixture.

It is well known by those skilled in the art that at different pressures, the composition of a given azeotrope will vary—at least to some degree—and changes in pressure will also change—at least to some degree—the boiling point temperature. Thus an azeotrope of A, B and C represents a unique type of relationship but with a variable composition which depends on temperature and/or pressure. Therefore compositional ranges, rather than fixed compositions, are often used to define azeotropes.

The composition can be defined as a particular weight percent relationship or mole percent relationship of A, B and C, while recognizing that such specific values point out only one particular such relationship and that in actuality, a series of such relationships, represented by A, B and C actually exist for a given azeotrope, varied by the influence of pressure.

Azeotrope A, B and C can be characterized by defining the composition as an azeotrope characterized by a boiling point at a given pressure, thus giving identifying characteristics without unduly limiting the scope of the invention by a specific numerical composition, which is limited by and is only as accurate as the analytical equipment available.

Ternary mixtures of 24–34 weight percent 2-chloro-1,1,2-trifluoroethyl-2-difluoromethyl ether and 54–74 weight percent trans-1,2-dichloroethylene and 4–10 weight percent methanol are characterized as a zeotropes, in that mixtures within this range exhibit a substantially constant boiling point at constant pressure. Being substantially constant boiling, the mixtures do not tend to fractionate to any great extent upon evaporation. After evaporation, only a small difference exists between the composition of the vapor and the composition of the initial liquid phase. This difference is such that the compositions of the vapor and liquid phases are considered substantially identical. Accordingly, any mixture within this range exhibits properties which are characteristic of a true ternary azeotrope. The ternary composition consisting of about 28.9 weight percent 2-chloro-1,1,2-trifluoroethyl-2-difluoromethyl ether, 63.7 weight percent trans-1,2-dichloroethylene and 7.4 weight percent methanol has been established, within the accuracy of the fractional distillation method, as a true ternary azeotrope, boiling at about 42.2° C., at substantially atmospheric pressure.

The aforestated azeotrope has a low ozone-depletion potential and is expected to decompose almost completely, prior to reaching the stratosphere.

The azeotrope of the present invention permits easy recovery and reuse of the solvent from vapor defluxing and degreasing operations because of its azeotropic nature. In addition, the azeotrope of the present invention is useful as an aerosol propellant, refrigerant and blowing agent. As one example, the azeotropic mixture of this invention can be used in cleaning processes such as described in U.S. Pat. No. 3,881,949, which is incorporated herein by reference.

The azeotrope of the present invention can be prepared by any convenient method including mixing or combining the desired component amounts. A preferred method is to weigh the desired component amounts and thereafter combine them in an appropriate container.

EXAMPLE 1

A solution which contained 50.5 weight percent 2-chloro-1,1,2-trifluoroethyl-2-difluoromethyl ether, 42.8 weight percent trans-1,2-dichloroethylene and 6.7 weight percent methanol was prepared in a suitable container and mixed thoroughly.

The solution was distilled in 25 plate Oldershaw distillation column, using about a 10:1 reflux to take-off ratio. Head temperatures were read directly to 0.1° C. All temperatures were adjusted to 760 mm pressure. Distillate compositions were determined by gas chromatography. Results obtained are summarized in Table 1.

TABLE 1

Distillation of: (50.0 + 42.8 + 6.7) 2-CHLORO-1,1,2-TRIFLUOROETHYL-2-DIFLUOROMETHYL ETHER (CTDE), TRANS-1,2-DICHLOROETHYLENE (T-DCE) AND METHANOL (MEOH)

| Cuts | Temperature, °C. Head | Wt. % Distilled or Recovered | CTE | T-DCE | MEOH |
|---|---|---|---|---|---|
| 1 | 42.2 | 10.2 | 27.4 | 65.2 | 7.4 |
| 2 | 42.0 | 22.4 | 28.2 | 64.2 | 7.5 |
| 3 | 42.1 | 32.3 | 28.2 | 64.4 | 7.4 |
| 4 | 42.2 | 41.3 | 28.7 | 63.9 | 7.4 |
| 5 | 42.7 | 52.3 | 32.0 | 61.0 | 6.9 |
| heel | 51.0 | 89.4 | 81.4 | 12.1 | 6.5 |

Analysis of the above data indicates very small differences among head temperatures and distillate compositions, as the distillation progressed. A statistical analysis of the data indicates that the true ternary azeotrope of 2-chloro-1,1,2-trifluoroethyl-2-difluoromethyl ether, trans-1,2-dichloroethylene and methanol has the following characteristics at atmospheric pressure (99 percent confidence limits):

| | | |
|---|---|---|
| 2-chloro-1,1,2-trifluoroethyl-2-difluoromethyl ether | = | 28.9 ± 5.4 wt. % |
| trans-1,2-Dichloroethylene | = | 63.7 ± 4.8 wt. % |
| Methanol | = | 7.4 ± 0.7 wt. % |
| Boiling Point, °C. | = | 42.2 ± 1.1 |

EXAMPLE 2

Several single sided circuit boards were coated with activated rosin flux and soldered by passing the boards over a preheater, to obtain top side board temperatures of approximately 200° F. (93° C.), and then through 500° F. (260° C.) molten solder. The soldered boards were defluxed separately, with the azeotropic mixture cited in Example 1 above, by suspending a circuit board, first, for three minutes in the boiling sump, which contained the azeotropic mixture, then, for one minute in the rinse sump, which contained the same azeotropic mixture, and finally, for one minute in the solvent vapor above the boiling sump. The boards cleaned in the azeotropic mixture had no visible residue remaining thereon.

I claim:

1. An azeotropic composition consisting essentially of from about 24 to 34 weight percent 2-chloro-1,1,2-trifluoroethyl-difluoromethyl ether, from about 54 to 74 weight percent trans-1,2-dichloroethylene and from about 4 to 10 weight percent methanol, said azeotropic composition having a boiling point of about 42.2°+1.1° C. at substantially atmospheric pressure.

2. The azeotropic composition of claim 1, wherein the composition is about 28.9 weight percent 2-chloro-1,1,2-trifluoroethyl-2-difluoromethyl ether, and about 63.7 weight percent trans-1,2-dichloroethylene and about 7.4 weight percent methanol.

3. The azeotropic composition of claim 1 wherein the composition has a boiling point of about 42.2° C. at substantially atmospheric pressure.

4. A process for cleaning a solid surface which comprises treating said surface with the azeotropic composition of claim 1.

5. The process of claim 4, wherein the solid surface is a printed circuit board contaminated with flux and flux-residues.

6. The process of claim 4, wherein the solid surface is a metal.

7. A process for heating or cooling comprising the use of the azeotropic composition of claim 1.

8. A process for preparing a polymeric foam utilizing an effective amount of the azeotropeic composition of claim 1, said azeotropic composition functioning as a blowing agent.

9. A process of preparing aerosol formulations wherein the active ingredients are combined in an aerosol container with the azeotropic composition of claim 1 said azeotropic composition functioning as a propellant.

* * * * *